US006609636B1

(12) United States Patent
Petriekis et al.

(10) Patent No.: US 6,609,636 B1
(45) Date of Patent: Aug. 26, 2003

(54) FLEXIBLE CONTAINER FOR BAG-IN-BOX PACKAGING SYSTEM

(75) Inventors: Paul F. Petriekis, Palos Park, IL (US); Wade H. Williams, Romeoville, IL (US)

(73) Assignee: Packaging Systems LLC, Romeoville, IL (US)

( * ) Notice: Subject to any disclaimer, the term of this patent is extended or adjusted under 35 U.S.C. 154(b) by 0 days.

(21) Appl. No.: 09/580,144

(22) Filed: May 30, 2000

(51) Int. Cl.[7] ..... B65D 35/56
(52) U.S. Cl. ..... 222/105; 222/464.1
(58) Field of Search ..... 222/105, 464.1

(56) References Cited

U.S. PATENT DOCUMENTS 4,381,846 A * 5/1983 Heck ..... 222/105
4,484,697 A 11/1984 Fry, Jr.
4,524,458 A * 6/1985 Pongrass et al. ..... 222/105
4,601,410 A 7/1986 Bond
4,815,631 A 3/1989 Eeg et al.
4,893,731 A * 1/1990 Richter ..... 222/105
5,147,071 A 9/1992 Rutter et al.
5,647,511 A 7/1997 Bond
5,749,493 A 5/1998 Boone et al.
5,915,596 A * 6/1999 Credle, Jr. ..... 222/105
5,941,421 A 8/1999 Overman et al.
6,012,611 A 1/2000 Schroeder
6,045,006 A * 4/2000 Frazier et al. ..... 222/105
6,102,252 A * 8/2000 Overman et al. ..... 222/105
6,179,173 B1 1/2001 Frazier et al.
6,223,981 B1 5/2001 Gunder

* cited by examiner

*Primary Examiner*—Philippe Derakshani
(74) *Attorney, Agent, or Firm*—Joseph A. Fuchs; Michael S. Leonard

(57) ABSTRACT

The present invention provides a bag-in-box packaging system having a paperboard box having sidewalls defining an interior chamber, and a flexible polymeric container positioned within the sidewalls of the box. The container having sidewalls sealed together along a peripheral edge to define a fluid chamber therebetween, the container having a dispensing fitment attached to a sidewall, the container further having a supplemental seam to direct fluid in an area proximate the fitment.

86 Claims, 3 Drawing Sheets

FLEXIBLE CONTAINER FOR BAG-IN-BOX PACKAGING SYSTEM

TECHNICAL FIELD

The present invention relates generally to a bag-in-box packaging system and more particularly to a flexible container for a bag-in-box system having a supplemental seal to direct a flowable material to a fitment of the container.

BACKGROUND OF THE INVENTION

Collapsible plastic bags are often used to store liquid products such as chemicals, soft drink syrup, fruit juices and food condiments. The plastic bags are typically housed in a corrugated paperboard box to aid in the transporting, handling and dispensing of the product. Such packaging systems are commonly referred to as "bag-in-box" packaging systems.

The plastic bags typically have sidewalls sealed along a peripheral seam to define a fluid containing chamber. A spout or a fitment provides access to the fluid chamber for filling and dispensing the product within the bag. Vacuum pump systems are sometimes connected to the container to assist in draining fluid from the container. Because fluid is sometimes trapped within folds of the container during draining evacuation channels are often placed within the bag. Evacuation channels are typically elongate cylindrical tubes or flat strips with protruding ribs defining grooves. Typically, one end of the evacuation channel is disposed transverse to, or is connected to the spout, and the other end of the evacuation channel extends into the fluid containing chamber of the bag. As the bag is emptied by the force of the vacuum pump, portions of the bag collapse unevenly, tending to leave pockets of product, typically liquid, which may become isolated from the rest of the liquid in the container. The evacuation channel, however, forms a conduit which cannot be closed off by the vacuum pressure on the walls of the bag. In this manner the entire chamber of the flexible bag remains in communication with the spout at all times during the dispensing such that all product within the bag can be removed.

Prior attempts to provide such bags are disclosed in U.S. Pat. Nos. 4,601,410; 5,647,511 and 5,749,493U.S. Pat. Nos. 4,601,410 and 5,647,511 disclose a liquid container with an evacuation unit. In both the '410 and '511 patents, the evacuation unit is shown attached directly to the spout by a mounting ring.

Several problems have been encountered with these types of evacuation units. For example, during the filling process, which is typically done in a high speed and high pressure process, the evacuation unit is susceptible of being dislodged from the spout thereby rendering the evacuation unit inoperative. Also, the attaching ring can impede the flow of liquid during the filling process thereby slowing the filling process.

U.S. Pat. No. 5,749,493 discloses an evacuation unit positioned within a bag and transverse and perpendicular to a spout in the bag. Because the evacuation unit is positioned in a location that is in line with the incoming fluid during the filling process, it is susceptible of being dislodged from its mounting to the container thereby rendering it ineffective.

Other designs and configurations, beyond the three enumerated above, have been utilized by the flexible container industry but those designs have a number of inherent flaws. Foremost among those problems is the requirement of manual insertion of the evacuation channel after the container has been filled with liquid contents. This is highly undesirable because it adds another step to the manufacturing process and increases the labor costs.

Other bag-in-box systems provide for mounting the bag-in-box system into a compartment of a fluid dispenser. The fluid dispenser has a valve that controls the delivery of fluid from the container and the fluid flows from the container by the force of gravity. Such dispensers are commonly used for dispensing non-carbonated beverages such as fruit juices. Containers of this type have suffered from the same problems mentioned above. During the evacuation of the container a significant quantity of fluid can be trapped in the folds of the container which cannot be recovered during a normal dispensing process. In a 2 gallon bag residual fluid in the amount of 12 to 16 ounces has commonly been reported to be wasted upon disposal of the container.

SUMMARY OF THE INVENTION

The present invention provides a bag-in-box container system, a container for a bagin-box container system and a method for forming a bag-in-box container system that allows for near complete evacuation of the container without the need of an evacuation unit.

The present invention provides a bag-in-box packaging system having a paperboard box having sidewalls defining an interior chamber and a flexible polymeric container positioned within the sidewalls of the container. The container has sidewalls sealed together along a peripheral edge to define a fluid chamber therebetween. The container also has a dispensing fitment attached to a sidewall and a supplemental seam to direct fluid in an area proximate the fitment.

DETAILED DESCRIPTION

Figure 1:
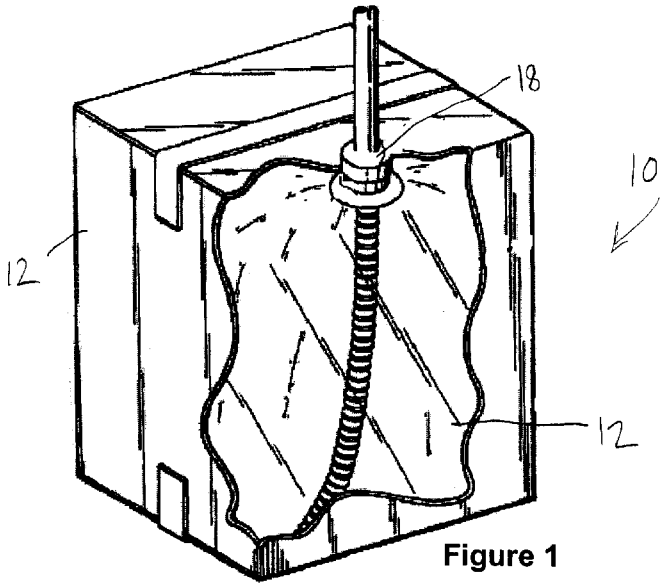
FIG. 1 is a prior art bag-in-box system.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiments illustrated.

FIG. 1 shows a prior art bag-in-box system 10. The system 10 has a paperboard box 12 and a flexible polymeric container 14 inserted within the box 14. The box 14 will typically have an access door dimensioned to provide access to a fitment 18 of the flexible container 14. The fitment 18 provides access to the fluid contents of the container 14.

Figure 2:
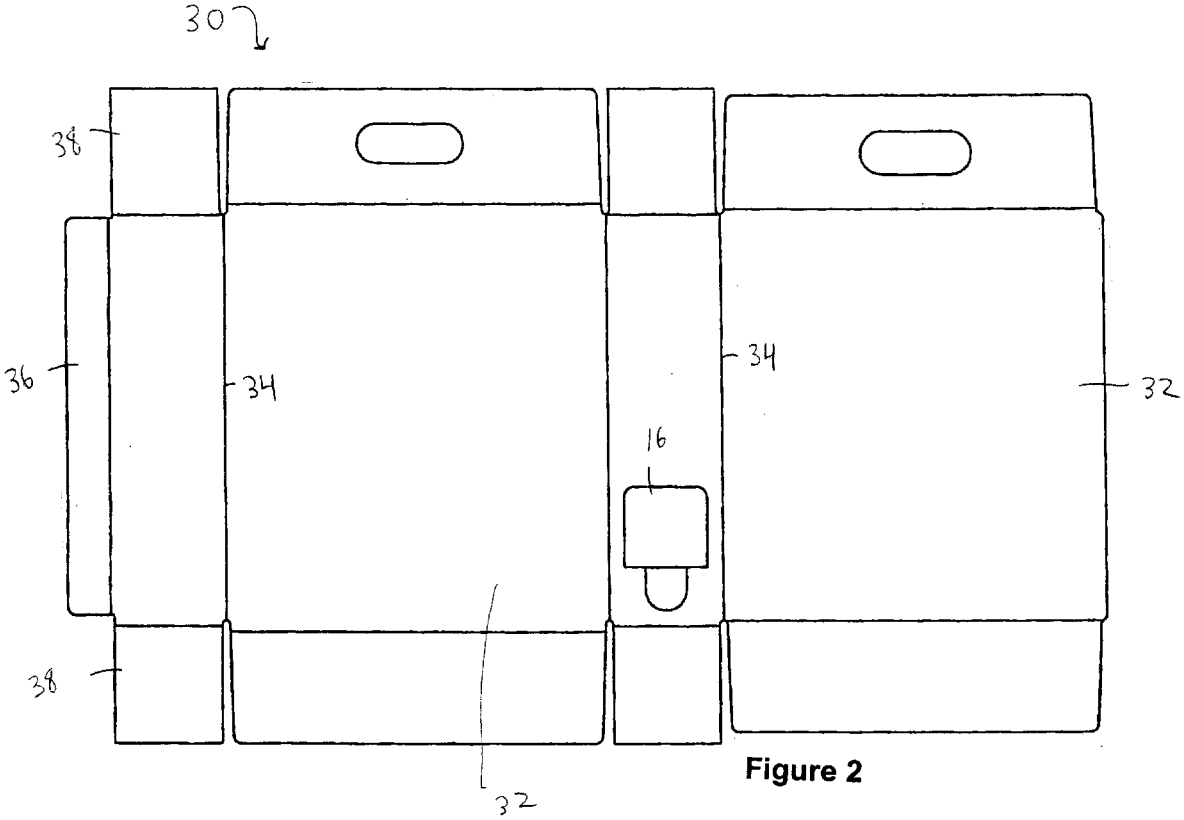
FIG. 2 is a plan view of a paperboard blank that can be folded into a box.

The present invention provides a bag-in-box system that allows for more complete drainage of the contents of the container 14 when compared to prior art containers. In a preferred form of the present invention the box is fabricated from a corrugated paperboard blank 30 shown in FIG. 2. The blank has panels 32 separated by fold lines 34. The panels when folded define sidewalls of the box. The blank has a major flap 36 and two minor flaps 38 that when folded form a bottom wall of the box. Unlike prior developed boxes, the present invention provides for forming the bottom wall of the box 12 by folding the major flap 36 inward to define a continuous bottom wall followed by folding the two minor flaps 38 inward on top of the major flap 36. Prior art containers typically are formed by folding the minor flaps inward followed by folding the major flap over the minor flaps. What is meant by a continuous bottom wall is the bottom wall is smooth, continuous and uninterrupted from one lateral edge of the box to the other. There are no joints as in prior art boxes where the two minor flaps abut one another.

Figure 3:
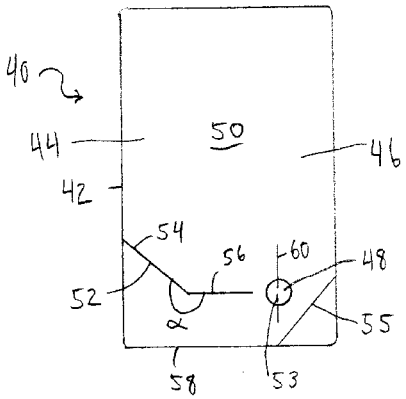
FIG. 3 is a plan view of a container of the present invention.

FIG. 3 shows the flexible polymeric container 40 having a peripheral seam 42 to define a fluid chamber 44 therebetween. The container can be formed by two sheets of material placed in registration and sealed along four edges. The container can also be formed from a sheet of material folded and the other three sides sealed. The container 40 shown in FIG. 3 has a generally rectangular shape but could be of many different shapes such as other polygonal shapes such as triangular, square, pentagonal, hexagonal, octagonal, etc., or round or oval without departing from the present invention. The container 40 has sidewalls 46 and a fitment 48 attached to an outer surface 50 of one of the sidewalls 46. The fitment could also be a tubing or other access device attached to both sidewalls 46.

A supplemental seam 52 is provided for directing fluid to an area proximate an opening 53 of the fitment 48. As is shown in FIGS. 3–20, the supplemental seam can be effective in many forms. The supplemental seam of FIG. 3 has a first portion 54 and a second portion 56. The first portion 54 extends in a direction to intersect a leg or bottom wall 58 of the peripheral seam 42 container 40. The second portion 56 extends in a direction to intersect a diameter line 60 of the fitment opening 53. An angle a between the first portion 54 and the second portion 56 should be from about 15° to about 179°, more preferably from about 45° to about 170°, and most preferably from about 90° to about 170°. FIG. 3 shows the angle $\alpha$ being greater than 90°. The container can optionally have a back stop seal 55 to further help direct fluid to the fitment opening 53. Also a seam 57 between the back stop seal 55 and the point where the supplemental seal intersects the leg 58 can be rounded or have a shape other than a straight line such as a polygonal shape.

Figure 4:
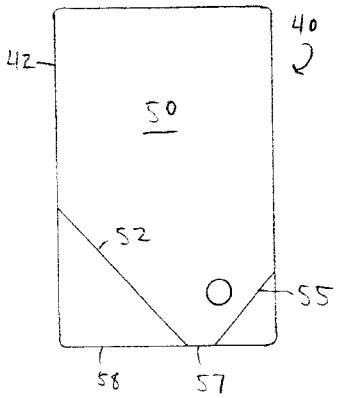
FIG. 4 is a plan view of a container of the present invention.

FIG. 4 shows the supplemental seam 52 as a straight line extending toward the leg 58 of the container. In a preferred form of the invention the supplemental seam 52 intersects the leg 58, but it is not necessary for it to do so to be effective.

Figure 5:
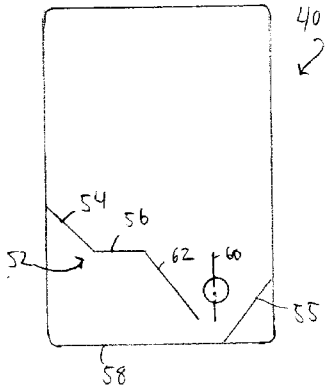
FIG. 5 is a plan view of a container of the present invention.

FIG. 5 shows a supplemental seam 52 with first, second and third portions 54, 56 and 62 cascading toward the bottom wall 58. The first and third portions steeply slope toward the bottom wall 58 while the second leg is either substantially parallel to the bottom wall 58 or slopes toward the bottom 58 at a less severe angle than the first and second legs 52, 54. The second leg 56 can also be positioned in a line to intersect the diameter 60 or in a line that extends above or below the fitment opening 53. It is contemplated that more than three legs can be provided without departing from the present invention. Again, in a preferred form of the invention the supplemental seam 52 intersects the bottom wall 58. However, it is contemplated that the supplemental seam 52 can be effective without intersecting the bottom wall 58.

Figure 6:
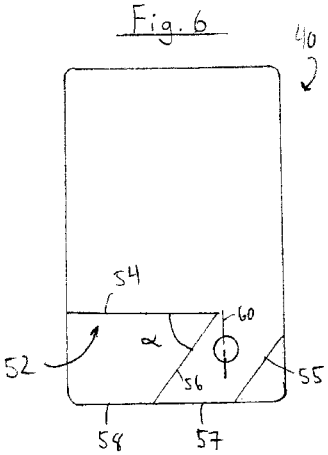
FIG. 6 is a plan view of a container of the present invention.

FIG. 6 shows the supplemental seam 52 where cc is less than 90°. The first portion 54 extends in a direction substantially parallel to the bottom wall 58 but could also slope downward or upward if desired. The first portion 52 preferably extends to a point over the fitment or beyond and the second portion 56 extends backward behind the fitment. The first portion 54 extends in a line that does not intersect the diameter 60. but could be positioned to extend in a line to intersect the diameter 60 and stop short of the fitment. Of course, it is also contemplated that the first portion can extend above the fitment but not as far as the fitment without departing from the invention. Again, in a preferred form of the invention the supplemental seam 52 intersects the bottom wall 58. However, it is contemplated that the supplemental seam 54 can be effective without intersecting the bottom wall 58.

Figure 7:
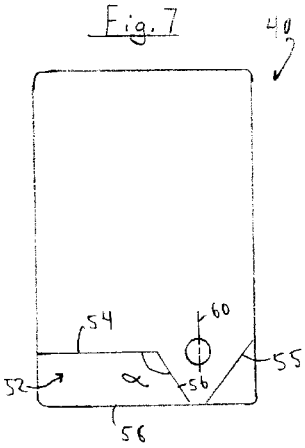
FIG. 7 is a plan view of a container of the present invention.

FIG. 7 shows the first leg 54 extending in a direction substantially parallel to the bottom wall 58 and in a line to intersect the diameter 60 and the second leg extends downward toward the bottom wall. The angle a is greater than 90°. The first portion could also be positioned to extend in a line above the fitment or below the fitment without departing from the present invention.

Figure 8:
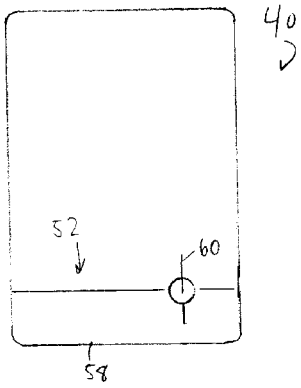
FIG. 8 is a plan view of a container of the present invention.

FIG. 8 shows the supplemental seam 52 extending parallel to the bottom wall 58 and intersecting the diameter 60 of the fitment opening.

Figure 9:
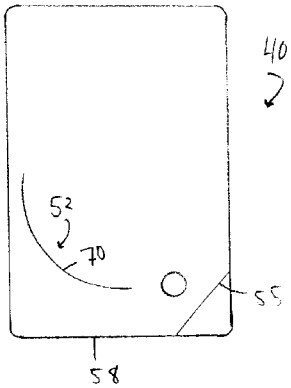
FIG. 9 is a plan view of a container of the present invention.

FIG. 9 shows the supplemental seam 52 having a curved profile having a convex portion 70 facing the fitment opening 53. It is contemplated that the curve could be positioned to face a convex portion of the curve toward the fitment opening as well.

Figure 10:
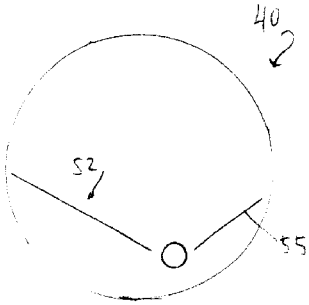
FIG. 10 is a plan view of a container of the present invention.
Figure 11:
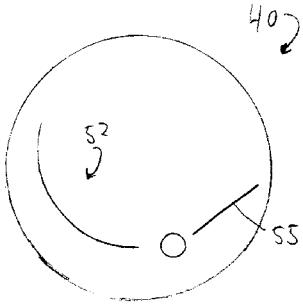
FIG. 11 is a plan view of a container of the present invention.

FIG. 10 shows a container having a substantially round shape and having a supplemental seam that extends in a straight line toward the spout opening and FIG. 11 shows a substantially round-shaped container having a curved supplemental seam. Of course any of the above described supplemental seams could be placed within a round container without departing from the present invention.

Figure 12:
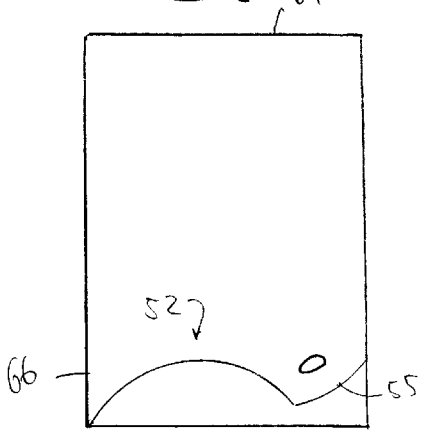
FIG. 12 is a plan view of a container of the present invention.

FIG. 12 shows supplemental seam 52 having a curved profile with a convex portion of the seam facing a top seam 64 of the container. The back stop seam 55 also has a curved profile different from the supplemental seam 52. The supplemental seam 52 extends substantially from the intersection of the bottom wall 58 and a sidewall 66. The supplemental seam 52 could extend from the bottom wall 58, or the sidewall 66 as well.

Figure 13:
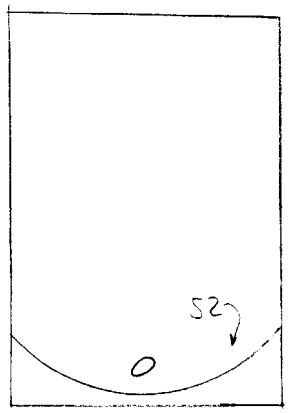
FIG. 13 is a plan view of a container of the present invention.
Figure 14:
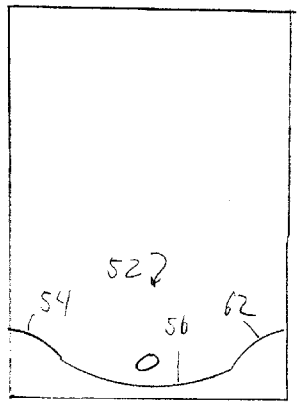
FIG. 14 is a plan view of a container of the present invention.
Figure 15:
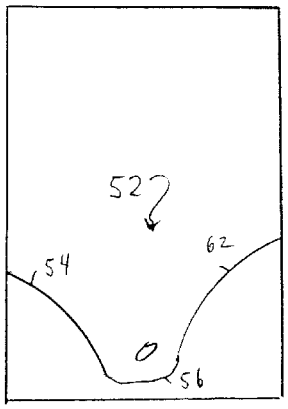
FIG. 15 is a plan view of a container of the present invention.

FIG. 13 shows supplemental seam 52 having a curved profile and extending between sidewalls 66 and below the fitment opening 53. Similarly FIGS. 14 and 15 show the supplemental seam 52 having first, second and third portions 54, 56 and 62 each having different curved profiles.

Figure 16:
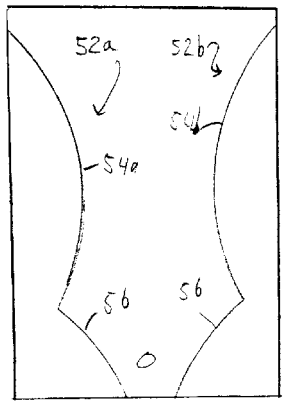
FIG. 16 is a plan view of a container of the present invention.
Figure 17:
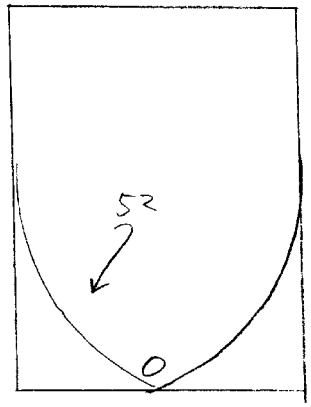
FIG. 17 is a plan view of a container of the present invention.

FIG. 16 shows a container having two supplemental seams 52*a* and 52*b*. Each supplemental seam 52*a* and 52*b* have a first portion 54 that has a curved profile with a convex portion facing an interior of the fluid chamber 44 and a second portion 56 having a curved profile also having a convex portion facing the interior of the fluid chamber 44. FIG. 17 shows a continuous supplemental seam 52 that generally resembles a plot of a hyperbola. The supplemental seam 52 extends below the fitment opening 53.

Figure 18:
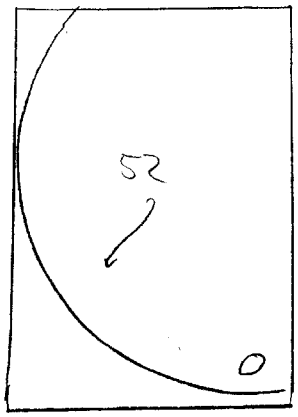
FIG. 18 is a plan view of a container of the present invention.
Figure 19:
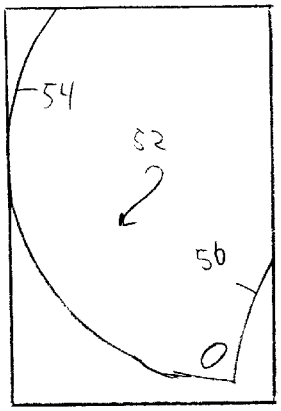
FIG. 19 is a plan view of a container of the present invention.

FIG. 18 shows a supplemental seam 52 having a curved profile a extending from the top seam 64 and extending below the fitment opening 53. Similarly, FIG. 19 shows a supplemental seam 54 having a curved profile and having a first portion 54 extending from the top seam 64 to a second portion having a straight or curved profile extending to a sidewall 66.

Figure 20:
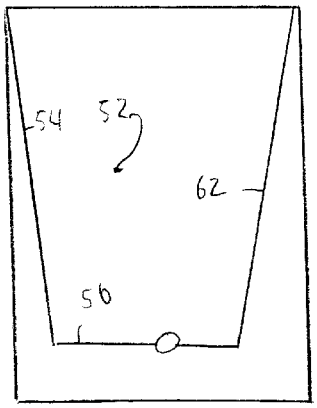
FIG. 20 is a plan view of a container of the present invention.

FIG. 20 shows a supplemental seam 52 having a first portion 54 extending from the top seam 64 to a second portion 56 extending in a line to intersect the diameter 60 of the fitment opening to a third portion 62 extending upward to the top seam 64 to form a generally trapezoidal shaped seam.

The container can be formed from polymeric material. In a preferred form of the invention the polymeric material has sufficient flexibility to collapse upon draining. The polymeric material can be of a monolayer film, a multiple layer film or have multiple sheets of monolayer or multiple layered films or combinations of the same. Suitable polymeric materials include polyolefins such as polyethylene, polypropylene, polybutene etc., ethylene and vinyl acetate copolymers, ethylene copolymerized with carboxylic acids having from 3 to 20 carbons and ester and anhydride derivatives thereof, ethylene and vinyl alcohol copolymers, polyamides, polyesters, polyvinyl vinyl chloride and the like. The film can be extruded, coextruded, cast, laminated and metalize. In a preferred form of the invention the container is a two-ply structure having a first ply of ethylene and vinyl alcohol copolymer and a second ply of polyethylene.

To further assist in evacuating the contents of the container 40, in a preferred form of the invention, a quantity of gas is inserted into the container 40 to form a bubble in the fluid contained in the container. The gas should be one that is non-flammable and does not chemically react with the fluid contents and should be selected from nitrogen, helium, neon, argon, krypton, and xenon. In a preferred form of the invention the gas is nitrogen. The quantity of gas should be of sufficient quantity to form a visible bubble and more preferably for a two gallon liquid filled container should create a bubble of from about 4 inches to about 12 inches long by about 4 to about 12 inches wide and more preferably from about 6 to about 11 inches long and about 6 to about 11 inches wide.

Examples

To demonstrate the enhanced fluid draining performance of the containers of the present invention, containers made in accordance with the present invention were tested and compared to a container without a supplemental seam. In particular, a first two-gallon container was fabricated from two sheets of a two ply material of EVOH and polyethylene. The two sheets were placed in registration and sealed along a peripheral edge to define a container of approximately 17" by 15". One of the sidewalls in the lower right hand corner of the container was punctured to accommodate a fitment. This container was filled with approximately two gallons of water. The container was inserted into a paperboard container formed from the blank shown in FIG. 2. The container had the minor flaps folded inward prior the major flap.

A second two-gallon container was formed in essentially the same fashion as the first container except a supplemental seal was provided in a form substantially as shown in FIG. 7 and as described in detail above. Also, after the second container was filled with 2 gallons of liquid a quantity of nitrogen gas was added to the second container to form a bubble of approximately 8 inches long by 8½ inches wide. The second container was also placed in box formed from a blank shown in FIG. 1 but the major flap was folded inward before folding of the minor flaps as discussed above.

The first and second bag-in-box systems were loaded in a fluid dispensing apparatus with the fitment positioned toward the bottom of the apparatus. The fitment of each container pulled through the access door of the box and was opened to release the contents of the container by the force of gravity. The contents remaining in the containers were measured after a time no further fluid would drain. The first container had 13½ oz of fluid left in the container while the second container had 1¾ oz of fluid remaining in the container.

While the specific embodiments have been illustrated and described, numerous modifications come to mind without significantly departing from the spirit of the invention and the scope of protection is only limited by the scope of the accompanying claims.

We claim:

1. A bag-in-box packaging system comprising:

a paperboard box having sidewalls defining an interior chamber; and a flexible polymeric container positioned within the chamber, the container having sidewalls sealed together along a peripheral edge to define a fluid chamber therebetween, the container having a dispensing fitment attached to a sidewall, the container further having a supplemental seam sealing together at least a portion of the sidewalls to direct fluid in an area proximate the fitment wherein the supplemental seam has a first seam and a second seam and wherein said first and second seams do not intersect.

2. The system of claim 1 wherein the fitment is positioned proximate a leg of the peripheral edge of the container and wherein a portion of the supplemental seam extends in a line to intersect the leg.

3. The system of claim 2 wherein the first seam of the supplemental seam has a first portion and a second portion wherein the first portion extends along a first line and the second portion extends along a second line to define an angle between the first portion and the second portion, the angle being from about 15° to about 179°.

4. The system of claim 3 wherein the first portion is distal from the fitment and the second portion is proximate the fitment.

5. The system of claim 4 wherein the first portion is substantially parallel to a bottom of the container.

6. The system of claim 4 wherein the first portion extends in a line to intersect a bottom of the container.

7. The system of claim 4 wherein the first portion extends in a line to intersect a portion of a diameter of the fitment.

8. The system of claim 2 wherein the leg is a seam.

9. The system of claim 2 wherein the leg is a fold in the sidewalls.

10. The system of claim 1 wherein a portion of the first seam of the supplemental seam extends in a direction to intersect a portion of a diameter of the fitment.

11. The system of claim 1 wherein the fitment is attached to one sidewall of the container.

12. The system of claim 1 wherein the fitment is attached to two sidewalls of the container.

13. The system of claim 1 wherein the container has a fluid contained therein and a quantity of a gas to define a gas bubble.

14. The system of claim 13 wherein the gas does not react with the fluid.

15. The system of claim 14 wherein the gas is selected from the group of nitrogen, helium, neon, argon, krypton, and xenon.

16. The system of claim 1 wherein the box has an access door that is moveable from a closed position to an open position and is dimensioned to receive the fitment.

17. The system of claim 1 wherein the box has a continuous bottom wall.

18. A flowable materials container comprising:

the container having sidewalls of a flexible polymeric material sealed together along a peripheral edge to define a fluid chamber therebetween, the container having a dispensing fitment attached to at least one sidewall, the container further having a supplemental seam sealing together at least a portion of the sidewalls to direct fluid in an area proximate the fitment wherein the supplemental seam has a first seam and a second seam and wherein said first and second seams do not intersect.

19. The container of claim 18 wherein the fitment is positioned proximate a leg of the peripheral edge of the container and wherein a portion of the supplemental seam extends in a line to intersect the leg.

20. The container of claim 19 wherein the supplemental seam has a first and second portion wherein the first portion extends along a first line and the second portion extends along a second line to define an angle between the first portion and the second portion, the angle being from about 15° to about 179°.

21. The container of claim 20 wherein the first portion is distal from the fitment and the second portion is proximate the fitment.

22. The container of claim 21 wherein the first portion is substantially parallel to a bottom of the container.

23. The container of claim 21 wherein the first portion extends in a line to intersect a bottom of the container.

24. The container of claim 21 wherein the first portion extends in a line to intersect a portion of a diameter of the fitment.

25. The container of claim 19 wherein the leg is a seam.

26. The container of claim 19 wherein the leg is a fold in the sidewalls.

27. The container of claim 1 wherein a portion of the first portion extends in a direction to intersect a portion of a diameter of the fitment.

28. The container of claim 18 wherein the fitment is attached to one sidewall of the container.

29. The container of claim 18 wherein the fitment is attached to two sidewalls of the container.

30. The container of claim 18 wherein the container has a fluid contained therein and a quantity of a gas to define a gas bubble.

31. The container of claim 30 wherein the gas does not react with the fluid.

32. The container of claim 31 wherein the gas is selected from the group of nitrogen, helium, neon, argon, krypton, and xenon.

33. A method for forming a bag-in-box system comprising the steps of:

providing a paperboard box having an interior chamber; and providing a container having sidewalls of a flexible polymeric material sealed together along a peripheral edge to define a fluid chamber therebetween, the container having a dispensing fitment attached to at least one sidewall, the container further having a supplemental seam sealing together at least a portion of the sidewalls to direct fluid in an area proximate the fitment, the container being dimensioned to fit within the interior chamber of the box wherein the supplemental seam has a first portion and a second portion and wherein the first portion and the second portion do not intersect.

34. The method of claim 33 wherein the step of providing a paperboard box comprises the steps of:

providing a paperboard blank having panels separated by fold lines; and folding the blank along the fold lines to define the box.

35. The method of claim 34 wherein the blank has a major flap and two minor flaps wherein the step of folding the blank comprises the steps of:

folding the major flap inward to define a continuous bottom wall; and folding the minor flaps inward on top of the major flap.

36. The container of claim 35 wherein the fitment is positioned proximate a leg of the peripheral edge of the container and wherein a portion of the supplemental seam extends in a line to intersect the leg.

37. The container of claim 36 wherein the first portion extends along a first line and the second portion extends along a second line to define an angle between the first portion and the second portion, the angle being from about 15° to about 179°.

38. The container of claim 37 wherein the first portion is distal from the fitment and the second portion is proximate the fitment.

39. The container of claim 38 wherein the first portion is substantially parallel to a bottom of the container.

40. The container of claim 38 wherein the first portion extends in a line to intersect a bottom of the container.

41. The container of claim 38 wherein the first portion extends in a line to intersect a portion of a diameter of the fitment.

42. The container of claim 36 wherein the leg is a seam.

43. The container of claim 36 wherein the leg is a fold in the sidewalls.

44. The container of claim 35 wherein a portion of the first supplemental seam extends in a direction to intersect a portion of a diameter of the fitment.

45. The container of claim 35 wherein the fitment is attached to one sidewall of the container.

46. The container of claim 35 wherein the fitment is attached to two sidewalls of the container.

47. The container of claim 35 wherein the container has a fluid contained therein and a quantity of a gas to define a gas bubble.

48. The container of claim 47 wherein the gas does not react with the fluid.

49. The container of claim 48 wherein the gas is selected from the group of nitrogen, helium, neon, argon, krypton, and xenon.

50. A bag-in-box packaging system comprising:

a paperboard box having sidewalls defining an interior chamber; and a flexible polymeric container positioned within the chamber, the container having sidewalls sealed together along a peripheral edge to define a fluid chamber therebetween, the peripheral edge having a pair of lateral seams, a top seam and a bottom seam, the container having a dispensing fitment attached to a sidewall, the container further having a supplemental seam sealing together at least a portion of the sidewalls to direct fluid in an area proximate the fitment wherein the supplemental seam intersects at least two of the other seams of the container.

51. The packaging system of claim 50 wherein the supplemental seam intersects one lateral seam and the top seam.

52. The packaging system of claim 50 wherein the supplemental seam intersects both the top seam and the bottom seam of the container.

53. The packaging system of claim 50 wherein the supplemental seam intersects both lateral seams of the container.

54. The packaging system of claim 50 wherein the supplemental seam intersects both lateral seams, the top seam and the bottom seam.

55. The packaging system of claim 50 wherein the supplemental seam intersects three seams of the container.

56. The system of claim 50 wherein the fitment is attached to one sidewall of the container.

57. The system of claim 50 wherein the fitment is attached to two sidewalls of the container.

58. The system of claim 50 wherein the container has a fluid contained therein and a quantity of a gas to define a gas bubble.

59. The system of claim 58 wherein the gas is inert to the fluid.

60. The system of claim 59, wherein the gas is selected from the group consisting of nitrogen, helium, neon, argon, krypton, and xenon.

61. The system of claim 50 wherein the box has an access door that is moveable from a closed position to an open position and is dimensioned to receive the fitment.

62. The system of claim 50 wherein the box has a continuous bottom wall.

63. A flowable materials container comprising:

sidewalls of a flexible polymeric material sealed together along a peripheral edge to define a fluid chamber therebetween, said peripheral edge having four sides consisting of a pair of lateral seams, a top seam and a bottom seam, the container having a dispensing fitment attached to at least one sidewall, the container further having a supplemental seam sealing together at least a portion of the sidewalls to direct fluid in an area proximate the fitment wherein the supplemental seam intersects at least two of the other seams of the container.

64. The packaging system of claim 63 wherein the supplemental seam intersects one lateral seam and the top seam of the container.

65. The packaging system of claim 63 wherein the supplemental seam intersects the top seam and the bottom seam of the container.

66. The packaging system of claim 63 wherein the supplemental seam intersects both lateral seams of the container.

67. The packaging system of claim 65 wherein the supplemental seam intersects both lateral seams, the top seam and the bottom seam of the container.

68. The packaging system of claim 63 wherein the supplemental seam intersects three seams of the container.

69. The container of claim 63 wherein the fitment is attached to one sidewall of the container.

70. The container of claim 63 wherein the fitment is attached to two sidewalls of the container.

71. The container of claim 63 wherein the container has a fluid contained therein and a quantity of a gas to define a gas bubble.

72. The container of claim 71 wherein the gas is inert.

73. The container of claim 72 wherein the gas is selected from the group consisting of nitrogen, helium, neon, argon, krypton, and xenon.

74. A method for forming a bag-in-box system comprising the steps of:

providing a paperboard box having an interior chamber; and providing a container having sidewalls of a flexible polymeric material sealed together along a peripheral edge to define a chamber therebetween, said peripheral edge having four seams consisting of a pair of lateral seams, a top seam and a bottom seam, the container having a dispensing fitment attached to at least one sidewall, the container further having a supplemental seam sealing together at least a portion of the sidewalls to direct fluid in an area proximate the fitment, the container being dimensioned to fit within the interior chamber of the box wherein the supplemental seam intersects at least two of the other seams of the container.

75. The method of claim 74 wherein the step of providing a paperboard box comprises the steps of:

providing a paperboard blank having panels separated by fold lines; and folding the blank along the fold lines to define the box.

76. The method of claim 75 wherein the blank has a major flap and two minor flaps wherein the step of folding the blank comprises the steps of:

folding the major flap inward to define a continuous bottom wall; and folding the minor flaps inward on top of the major flap.

77. The packaging system of claim 73 wherein the supplemental seam intersects one lateral seam and the top seam of the container.

78. The packaging system of claim 73 wherein the supplemental seam intersects both the top seam and bottom seam of the container.

79. The packaging system of claim 73 wherein the supplemental seam intersects both lateral seams of the container.

80. The packaging system of claim 73 wherein the supplemental seam intersects both of the lateral seams, the top seam and the bottom seam of the container.

81. The packaging system of claim 73 wherein the supplemental seam intersects three other seams of the container.

82. The container of claim 73 wherein the fitment is attached to one sidewall of the container.

83. The container of claim 73 wherein the fitment is attached to two sidewalls of the container.

84. The container of claim 73 wherein the container has a fluid contained therein and a quantity of a gas to define a gas bubble.

85. The container of claim 84 wherein the gas does not react with the fluid.

86. The container of claim 85 wherein the gas is selected from the group of nitrogen, helium, neon, argon, krypton, and xenon.

* * * * *